US008053959B2

(12) United States Patent
Lai

(10) Patent No.: US 8,053,959 B2
(45) Date of Patent: Nov. 8, 2011

(54) LED LAMP DEVICE

(75) Inventor: Cheng Hsiung Lai, Taipei County (TW)

(73) Assignees: Fin-Core Corp (TW); Color Stars, Inc (TW)

( * ) Notice: Subject to any disclaimer, the term of this patent is extended or adjusted under 35 U.S.C. 154(b) by 348 days.

(21) Appl. No.: 12/322,457

(22) Filed: Feb. 2, 2009

(65) Prior Publication Data

US 2009/0261705 A1 Oct. 22, 2009

(30) Foreign Application Priority Data

Apr. 22, 2008 (TW) ..... 97206830 U

(51) Int. Cl.
*H01J 7/24* (2006.01)
*H01J 61/52* (2006.01)
*H01K 1/58* (2006.01)

(52) U.S. Cl. ..... 313/33; 313/43; 313/45; 313/498; 313/512; 313/318.01

(58) Field of Classification Search ..... 313/17, 313/33, 37, 29, 40, 43, 45, 498, 512, 318.01
See application file for complete search history.

(56) References Cited

U.S. PATENT DOCUMENTS

2003/0048608 A1* 3/2003 Crocker et al. ..... 361/697
2006/0086484 A1* 4/2006 Hegde ..... 165/104.33
2007/0084595 A1* 4/2007 Lin et al. ..... 165/185
2009/0189169 A1* 7/2009 Wei ..... 257/98
2009/0323325 A1* 12/2009 Long et al. ..... 362/234
2010/0046168 A1* 2/2010 Liaw ..... 361/704
2010/0103675 A1* 4/2010 Yu et al. ..... 362/253

* cited by examiner

*Primary Examiner* — Bumsuk Won
*Assistant Examiner* — Kevin Quarterman

(57) ABSTRACT

A light-emitting diode (LED) lamp device includes at least one light-emitting module and a heat-dissipation module. The heat-dissipation module includes a plurality of cooling fins arranged in a radial pattern and connected annularly at intervals around the light-emitting module. Each of the cooling fins has an outer rim folded back a predetermined distance toward the light-emitting module to form a bent edge. The bent edges are formed with arcuate folded-back portions so that the cooling fins have rib-like outer perimeters after the bent edges are formed. Thus, the LED lamp device is allowed to be held safely by the folded-back portions while the cooling fins are structurally strengthened.

6 Claims, 6 Drawing Sheets

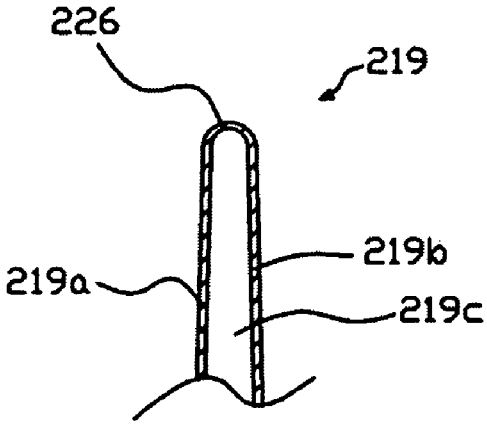
FIG. A1
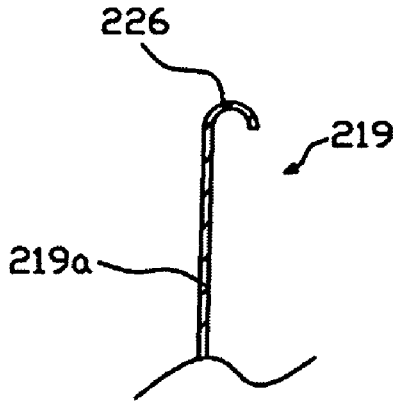
FIG. A2
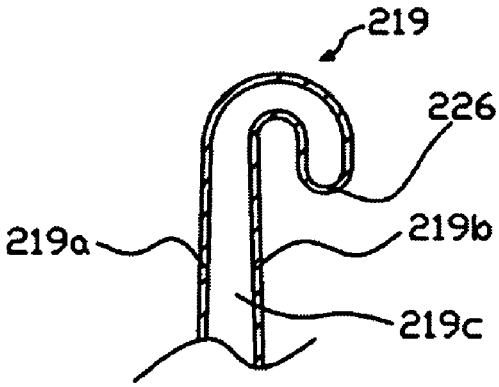
FIG. A3
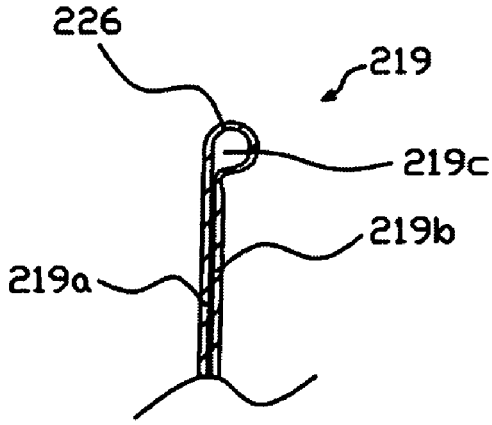
FIG. A4

A-A section

LED LAMP DEVICE

BACKGROUND OF INVENTION

1. Field of the Invention

The present invention relates to a light-emitting diode (LED) lamp device. More particularly, the present invention relates to a LED lamp device which includes a heat-dissipation module composed of a plurality of structurally enhanced and annularly connected cooling fins for rapidly dissipating heat generated by a LED unit of the LED lamp device.

2. Description of the Prior Art

Projection lamps have long taken a rather stable share of the light bulb market. A typical example of traditional projection lamps is the 110V halogen projection light bulbs, which, however, consume a lot of electricity, generate heat easily, and have a relatively short service life averaging only a few months. In an era of high electricity prices, the halogen projection light bulbs not only are environment-unfriendly, but may also cause electrical fires due to the high heat they generate.

Therefore, in view of the low electricity-consumption property of LEDs, developers put forward projection lamps using LEDs as a source of illumination to overcome the drawbacks of the traditional halogen projection light bulbs. Referring to FIG. 1, a conventional LED projection light bulb 1 is composed essentially of a metal housing 11, a voltage transforming unit 12, and an LED unit 13, wherein the LED unit 13 and the voltage transforming unit 12 are disposed inside the housing 11. The voltage transforming unit 12 transforms a 110V AC voltage into a DC voltage for use by the LED unit 13, thereby enabling the LED unit 13 to emit light for projection.

While the conventional LED projection light bulb 1 is more power-saving and more environment-friendly than the traditional halogen projection light bulbs, the LED unit 13 still has heat dissipation problems, which are aggravated by the fact that the LED unit 13 is less resistant to heat than the traditional halogen projection light bulbs, and, as soon as the temperature of the LED unit 13 rises above a preset allowable value, the brightness of light emitted by the LED unit 13 will begin to attenuate so that the desired illumination effect cannot be achieved, or the LED unit 13 may even have its normal service life cut short as a result.

As heat generated by the LED unit 13 during use can only be conducted gradually to ambient air by the metal housing 11, the LED unit 13 suffers from inefficient heat dissipation. Hence, the conventional LED projection light bulb 1 currently can only use an LED unit 13 of at most 1 W which produces limited brightness with no room for improvement. Therefore, despite the advent of the LED projection light bulb 1, popularity of the traditional halogen projection light bulbs remains unabated. Today, the heavily power-consuming and highly heat-generating traditional halogen projection light bulbs still have a significant market share and contribute to considerable waste of energy.

SUMMARY OF INVENTION

A primary objective of the present invention is to provide an LED lamp device comprising a light-emitting module and a heat-dissipation module composed of a plurality of cooling fins, wherein each of the cooling fins has an outer rim folded back a predetermined distance toward the light-emitting module to form a rib-like bent edge, such that each of the cooling fins is structurally strengthened against torsion and deformation.

A secondary objective of the present invention is to provide a LED lamp device comprising a heat-dissipation module composed of a plurality of cooling fins, wherein each of the cooling fins has an outer rim folded back to form a bent edge provided with a folded-back portion having a curved outer surface, thus allowing users to hold the LED lamp device with ease, but without being cut by the sharp outer rims of the cooling fins.

In order to achieve aforementioned objectives, the present invention discloses a light-emitting diode (LED) lamp device which includes at least one light-emitting module and a heat-dissipation module. The heat-dissipation module includes a plurality of cooling fins arranged in a radial pattern and connected annularly at intervals around the light-emitting module. Each of the cooling fins has an outer rim folded back a predetermined distance toward the light-emitting module to form a bent edge. The bent edges are formed with arcuate folded-back portions so that the cooling fins have rib-like outer perimeters after the bent edges are formed. Thus, the LED lamp device is allowed to be held safely by the folded-back portions while the cooling fins are structurally strengthened.

BRIEF DESCRIPTION OF THE DRAWINGS

The structure and the technical means adopted by the present invention can be best understood by referring to the following detailed description of the preferred embodiments and the accompanying drawings, wherein:

FIG. 1 is a perspective view of a conventional LED projection light bulb;

DETAILED DESCRIPTION OF PREFERRED EMBODIMENTS

Figure 2:
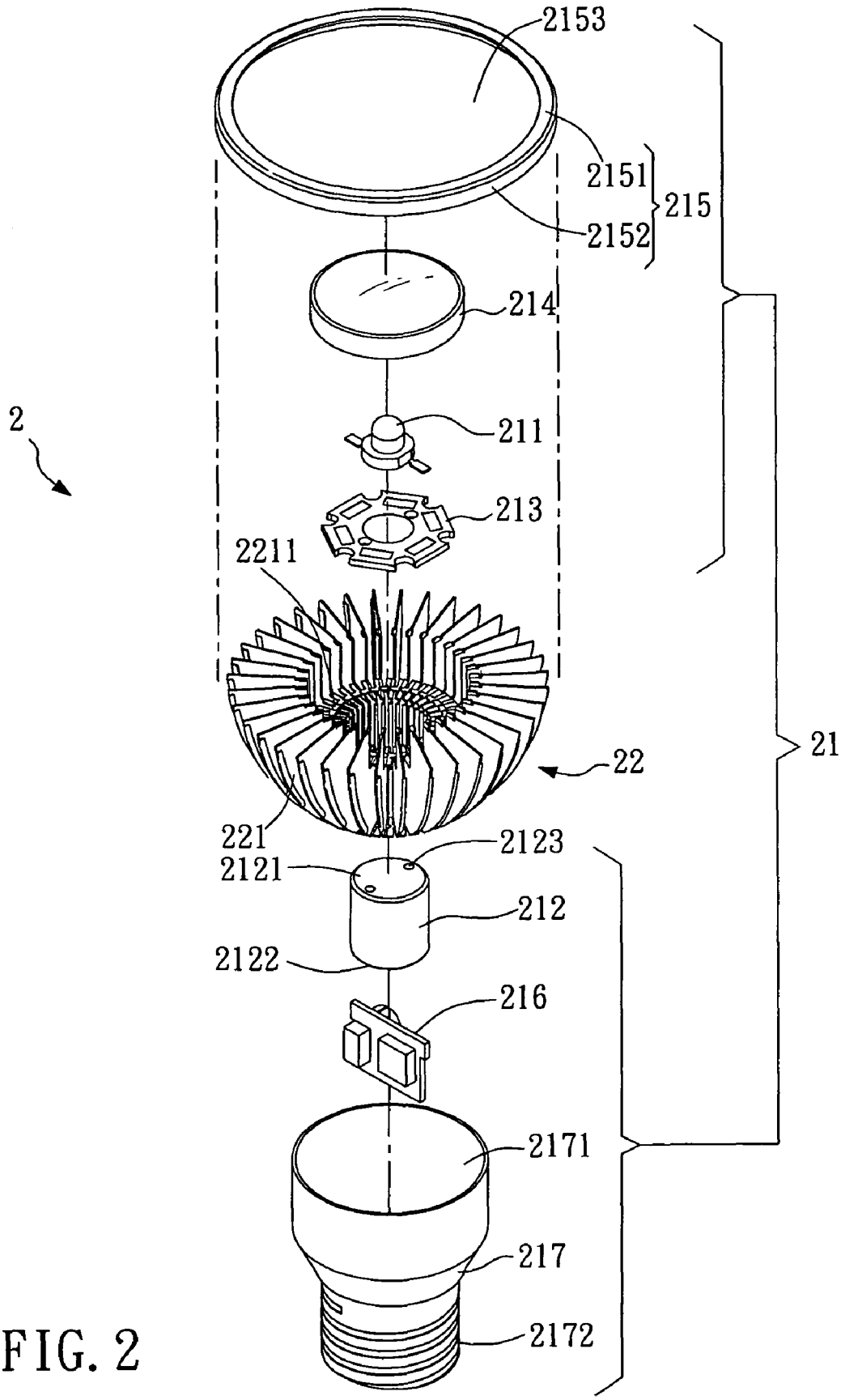
FIG. 2 is an exploded, perspective view of an LED lamp device according to a first preferred embodiment of the present invention.
Figure 3:
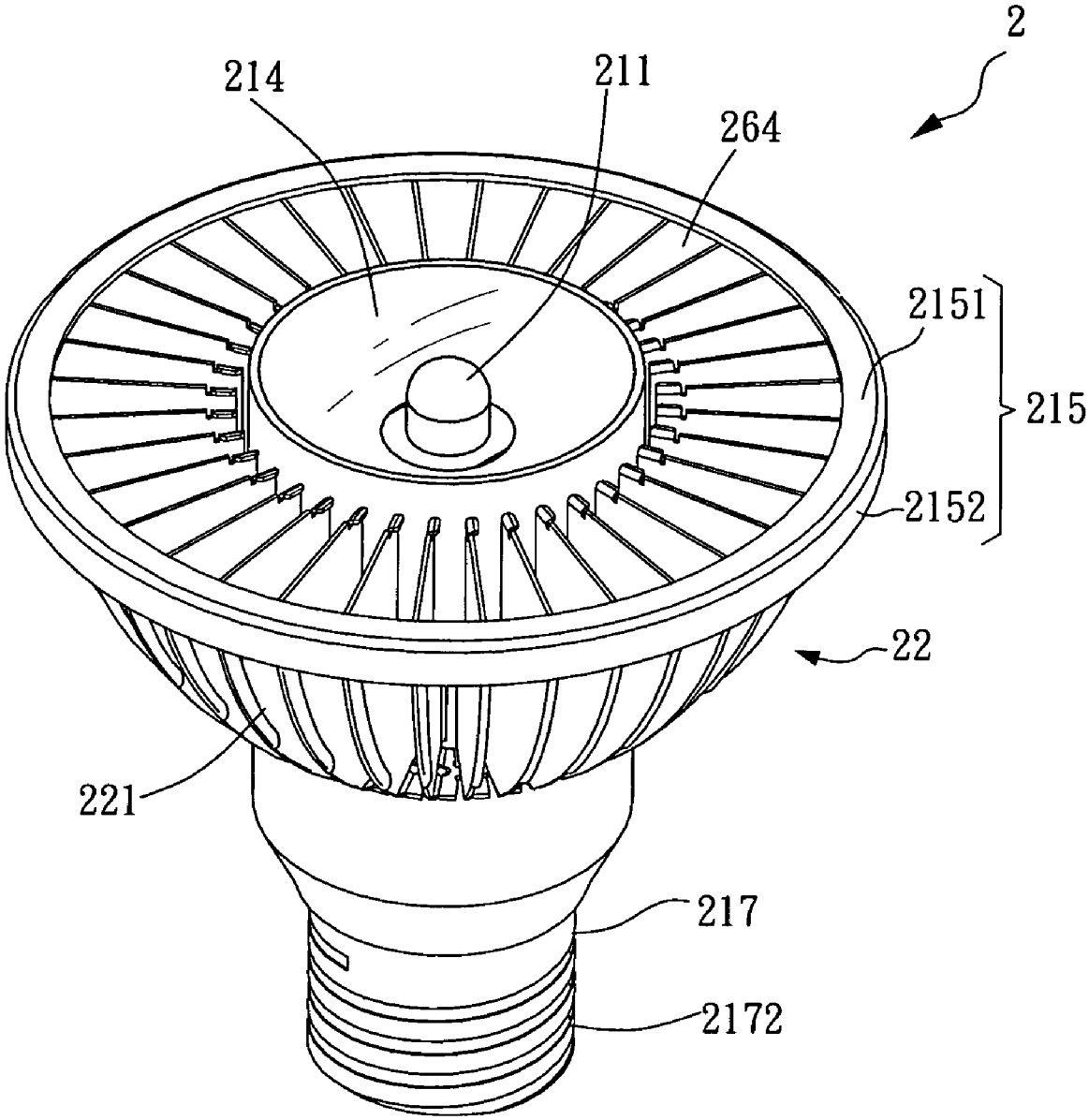
FIG. 3 is an assembled, perspective view of the LED lamp device according to the first preferred embodiment of the present invention.

Please refer to FIGS. 2 and 3 for an exploded, perspective view and an assembled, perspective view of an LED lamp device 2 according to a first preferred embodiment of the present invention, respectively. As shown in the drawings, the LED lamp device 2 comprises a light-emitting module 21 and a heat-dissipation module 22. The light-emitting module 21 further comprises at least one LED unit 211, a heat-conduction post 212, a substrate 213, a transparent cover 214, an annular protection cover 215, a circuit board 216, and a base 217. The heat-dissipation module 22 comprises a plurality of cooling fins 221 which are connected annularly at intervals around the light-emitting module 21 and arranged in a radial pattern.

The heat-conduction post 212 is formed in a cylindrical shape and has an upper end 2121 and a lower end 2122. The upper end 2121 is provided with at least one through hole 2123. The heat-conduction post 212 is made of a metal of high thermal conductivity, such as iron, copper, aluminum, silver, gold, or alloys thereof.

The plurality of cooling fins 221 of the heat-dissipation module 22, which are arranged in a radial pattern, are connected annularly at intervals around and in contact with an outer periphery of the heat-conduction post 212 of the light-emitting module 21. Each of the cooling fins 221 has a portion located above the upper end 2121 of the heat-conduction post 212 and recessed outward in relation to the heat-conduction post 212 by a predetermined distance so as to form a step-like cavity 2211 which encircles the upper end 2121 of the heat-conduction post 212 and is concentric with the heat-conduction post 212. The cooling fins 221 of the heat-dissipation module 22 are made of a metal of high thermal conductivity, such as iron, copper, aluminum, silver, gold, or alloys thereof.

The substrate 213, which is mounted with the LED unit 211, is received in the step-like cavity 2211 formed centrally in the heat-dissipation module 22 by the cooling fins 221 and rests on the upper end 2121 of the heat-conduction post 212. The substrate 213 is equipped with a plurality of IC capacitors for regulating the voltage needed by the LED unit 211 during illumination. In addition, heat generated by the LED unit 211 during illumination is conducted by the substrate 213 to the cooling fins 221 and then dissipated into ambient air. In this embodiment, the substrate 213 is made of a metal of high thermal conductivity, such as iron, copper, aluminum, silver, gold, or alloys thereof.

The transparent cover 214 is received in the step-like cavity 2211 centrally formed in the heat-dissipation module 22, lies in a path of light projected by the LED unit 211, and covers the LED unit 211. Thus, the transparent cover 214 not only renders uniform the light projected from the LED unit 211 but also prevents glare. The transparent cover 214 is a convex lens, a concave lens, a planar lens, or a diffuser plate.

The annular protection cover 215 is configured to framingly encircle an outer periphery of the cooling fins 221 and comprises an upper surface 2151 and a sidewall 2152. The upper surface 2151 is located above the heat-dissipation module 22 and centrally formed with an opening 2153 coaxial with the transparent cover 214. The sidewall 2152, which is connected with and surrounds the upper surface 2151, frames the heat-dissipation module 22 and thereby fixes the annular protection cover 215 in position to the heat-dissipation module 22. Consequently, the annular protection cover 215 is prevented from sliding relative to the heat-dissipation module 22 and, on the other hand, helps maintain a fixed spacing between every two adjacent cooling fins 221 to ensure high heat-dissipation efficiency.

The circuit board 216, which at least includes an electrical circuit, is disposed in the base 217 and electrically connected to the LED unit 211 mounted on the substrate 213 through the through hole 2123 of the heat-conduction post 212. The electrical circuit of the circuit board 216 regulates intensity of an input current in order to adjust brightness of light emitted by the LED unit 211.

The base 217 is a hollow shell having a receiving opening 2171 at a top of the hollow shell for receiving the circuit board 216 therein and engaging securely with the cooling fins 221 around the lower end 2122 of the heat-conduction post 212. The base 217 is externally provided with an electrically conductive thread 2172 connected electrically with the circuit board 27. In this embodiment, the electrically conductive thread 2172 of the base 217 conforms to specifications of metal screw thread fittings of traditional tungsten-filament light bulbs commonly seen on the market. The screw thread fittings are classified by size and designated accordingly by E10, E12, E14, E26, E27, E40, and so on, wherein the number following the letter E stands for a diameter of the electrically conductive thread 2172 in millimeters. For example, a household light bulb is generally of the size E27, which means the light bulb has a metal screw thread fitting with a thread diameter of 27 mm, or 2.7 cm.

Figure 4A:
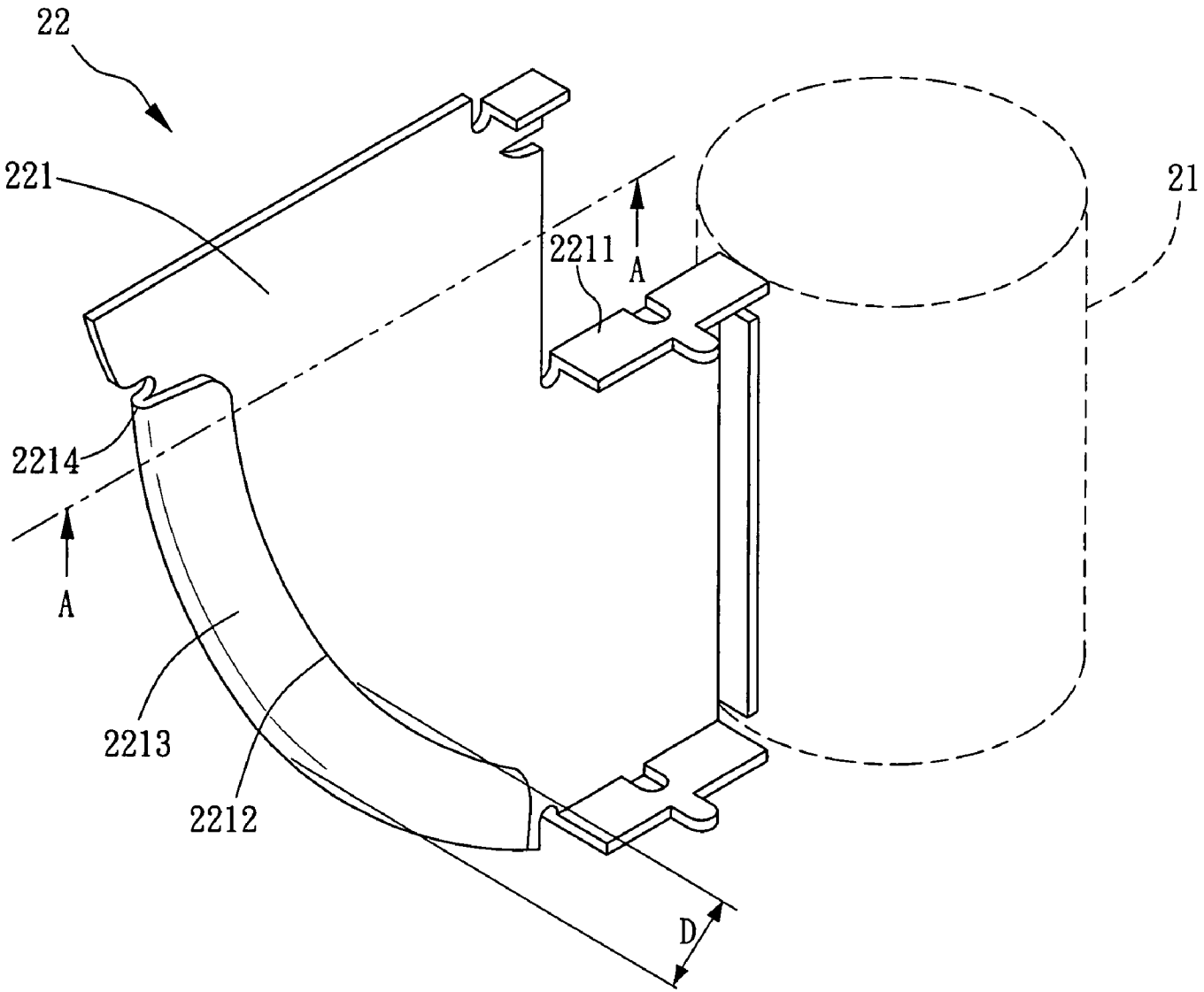
FIG. 4A is a perspective view of a cooling fin of the LED lamp device according to the present invention.

Please refer to FIG. 4A for a perspective view of one of the cooling fins 221 of the LED lamp device 2 according to the present invention. As mentioned above, the cooling fins 221 of the heat-dissipation module 22 are arranged in a radial pattern and connected annularly at intervals around the light-emitting module 21. Each of the cooling fins 221 has an outer rim 2212 folded back a predetermined distance D toward the light-emitting module 21 to form a bent edge 2213. The bent edge 2213 is formed with a substantially arcuate folded-back portion 2214 by a stamping process. Therefore, after the bent edge 2213 is formed, the cooling fin 221 is provided with a rib-like outer perimeter to protect users from being cut by the sharp outer rim 2212 of the metal cooling fin 221.

Figure 4B:
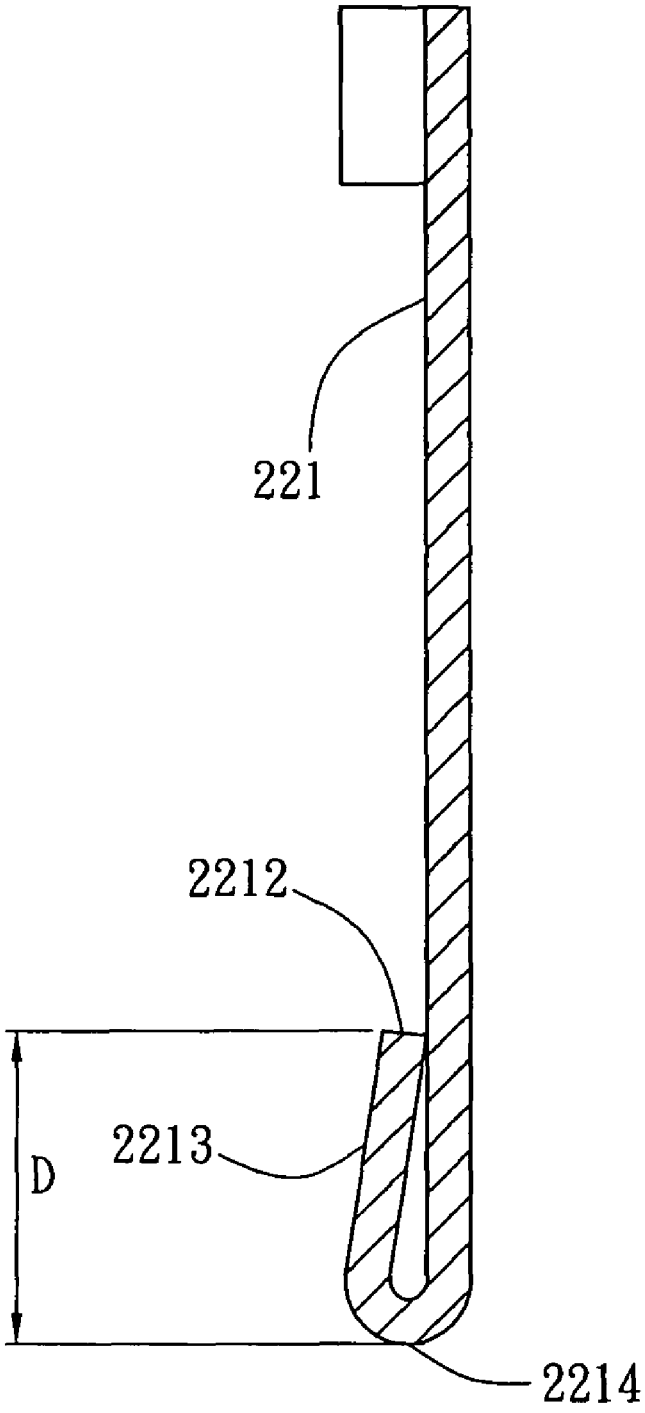
FIG. 4B is a sectional view of the cooling fin in FIG. 4A taken along a line A-A.

Refer now to FIG. 4B for a sectional view of the cooling fin 221 of the LED lamp device 2 according to the present invention, taken along a line A-A in FIG. 4A. Since the folded-back portion 2214 of the bent edge 2213 is curved toward the light-emitting module 21, the sharp outer rim 2212 of the metal cooling fin 221 is bent toward the light-emitting module 21 while the folded-back portion 2214 is provided with a generally smooth and curved outer surface, thus allowing a user to hold the LED lamp device 2 easily and safely by the folded-back portions 2214 without being cut by the outer rims 2212 of the metal cooling fins 221.

As previously mentioned, the cooling fin 221 is provided with the rib-like outer perimeter after the bent edge 2213 is formed. In this preferred embodiment, the bent edge 2213 lies generally close to a surface of the cooling fin 221 so that, after the bent edge 2213 is formed, the outer perimeter of the cooling fin 221 is generally twice as thick as the remaining portion of the cooling fin 221. Thus, the cooling fin 221 is reinforced so as to prevent distortion or deformation which might otherwise result from an excessive external force.

Provided below is a second preferred embodiment of the present invention, of which the majority of the components are identical or similar to their counterparts in the previous embodiment. For the sake of brevity and clarity, the same components and structures are given the same names and reference numerals and will not be described repeatedly.

Figure 5:
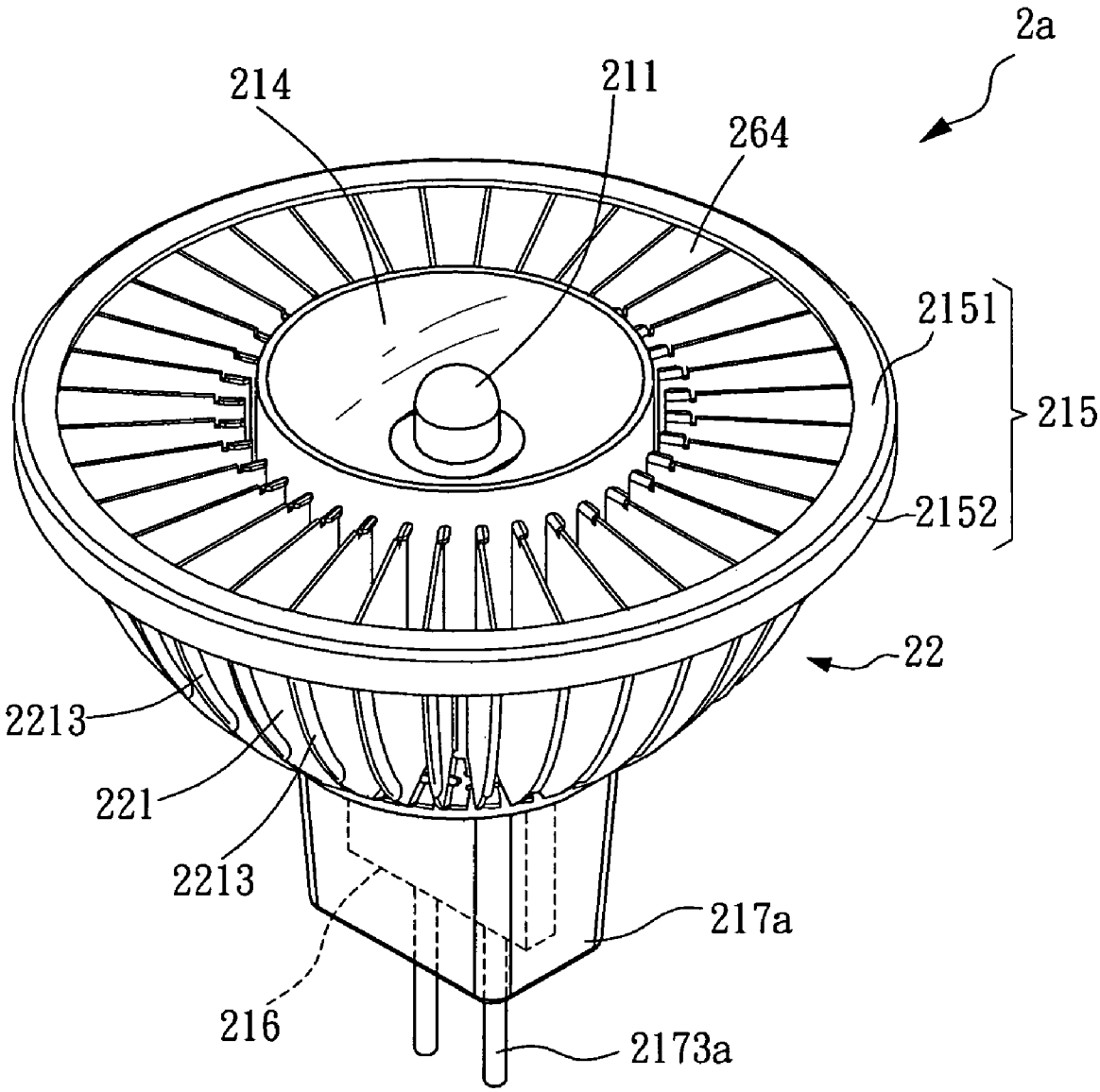
FIG. 5 is an assembled, perspective view of an LED lamp device according to a second preferred embodiment of the present invention.

FIG. 5 is an assembled, perspective view of an LED lamp device 2*a* according to the second preferred embodiment of the present invention. The LED lamp device 2*a* of the second preferred embodiment (shown in FIG. 5) differs from the LED lamp device 2 of the first preferred embodiment (shown in FIGS. 2 and 3) in that the LED lamp device 2*a* has a base 217*a* further provided with at least one pin 2173*a*. The pins 2173*a* are inserted into the base 217*a* and connected electrically with the circuit board 216, which transforms an externally supplied 110 or 220V AC voltage into a DC voltage suitable for operation of the LED unit 211.

In conclusion, the present invention provides an LED lamp device 2 comprising a light-emitting module 21 and a heat-dissipation module 22. The light-emitting module 21 further comprises at least one LED unit 211, a heat-conduction post 212, a substrate 213, a transparent cover 214, an annular protection cover 215, a circuit board 216, and a base 217. The heat-dissipation module 22 comprises a plurality of cooling fins 221 arranged in a radial pattern and connected annularly at intervals around the light-emitting module 21.

The plurality of cooling fins 221 of the heat-dissipation module 22, which are arranged in a radial pattern, are connected annularly at intervals around and in contact with an outer periphery of the heat-conduction post 212 of the light-emitting module 21. Each of the cooling fins 221 has a portion located above an upper end 2121 of the heat-conduction post 212 and recessed outward in relation to the heat-conduction post 212 by a predetermined distance so as to form a step-like cavity 2211 which encircles the upper end 2121 of the heat-conduction post 212 and is concentric with the heat-conduction post 212. Each of the cooling fins 221 has an outer rim 2212 folded back toward the light-emitting module 21 to form a bent edge 2213. The bent edges 2213 are formed with substantially arcuate folded-back portions 2214 by a stamping process, so that the cooling fins 221 have rib-like outer perimeters after the bent edges 2213 are formed, thereby individually increasing the structural strength of the cooling fins 221.

The substrate 213, which is mounted with the LED unit 211, is received in the step-like cavity 2211 formed centrally in the heat-dissipation module 22 by the cooling fins 221 and rests on the upper end 2121 of the heat-conduction post 212. The annular protection cover 215 framingly encircles an outer periphery of the cooling fins 221. The circuit board 216 is disposed in the base 217 and electrically connected through a through hole 2123 of the heat-conduction post 212 to the LED unit 211 mounted on the substrate 213. The base 217 receives the circuit board 216 therein and is either externally provided with an electrically conductive thread 2172 or equipped with at least one pin 2173*a* connected electrically with the circuit board 27.

Since the folded-back portions 2214 are curved, the sharp outer rims 2212 of the metal cooling fins 221 are bent toward the light-emitting module 21 while the folded-back portions 2214 are provided with generally smooth and curved outer surfaces, allowing a user to hold the LED lamp device 2 with ease, but without being cut by the outer rims 2212 of the metal cooling fins 221. Furthermore, after the bent edge 2213 is formed, the cooling fin 221 is provided with the rib-like and structurally enhanced outer perimeter, so that the LED lamp device 2 can be installed or held without its cooling fins 221 being distorted or deformed by an excessive external force.

The present invention has been described with preferred embodiments thereof, and it is understood that many changes and modifications to the described embodiment can be carried out without departing from the scope and the spirit of the invention that is intended to be limited only by the appended claims.

What is claimed is:

1. A light-emitting diode (LED) lamp device, comprising:

a light-emitting module, further comprising:

at least an LED unit;

a heat-conduction post, made of a metal of high thermal conductivity, formed in a cylindrical shape, having an upper end provided with at least a through hole, and a lower end;

a substrate mounted with the LED unit and disposed on the upper end of the heat-conduction post;

a transparent cover located centrally in the heat-dissipation module and covering the LED unit;

a circuit board comprising an electrical circuit and electrically connected though the through hole of the heat-conduction post to the LED unit mounted on the substrate; and a base formed as a hollow shell having a receiving opening at a top of the hollow shell for receiving the circuit board therein, the base being located at the lower end of the heat-conduction post; and a heat-dissipation module comprising a plurality of cooling fins arranged in a radial pattern and connected annularly at intervals around and in contact with an outer periphery of the heat conduction post of the light-emitting module, each said cooling fin having a sharp outer rim folded back a predetermined distance toward the light-emitting module so as to form a bent edge thereof;

wherein the bent edge has an arcuate folded-back portion and is folded close to a surface of the respective cooling fin, so that each said cooling fin is provided with a rib-like outer perimeter twice as thick as remaining portions of the respective cooling fin after the bent edge is formed.

2. The LED lamp device of claim 1, wherein the light-emitting module further comprises an annular protection cover for framingly encircling an outer periphery of the cooling fins and positioning the cooling fins.

3. The LED lamp device of claim 1, wherein the transparent cover is one of a convex lens, a concave lens, a planar lens, and a diffuser plate.

4. The LED lamp device of claim 1, wherein the heat-conduction post is made of a material selected from the group consisting of iron, copper, aluminum, silver, gold, and alloys thereof; and the substrate is made of a material selected from the group consisting of iron, copper, aluminum, silver, gold, and alloys thereof.

5. The LED lamp device of claim 1, wherein the base is externally provided with an electrically conductive thread which serves as a metal screw thread fitting and is connected electrically with the circuit board.

6. The LED lamp device of claim 1, wherein the base is further provided with at least a pin inserted into the base and connected electrically with the circuit board.

* * * * *